US005604514A

United States Patent [19]

Hancock

[11] Patent Number: 5,604,514

[45] Date of Patent: Feb. 18, 1997

[54] PERSONAL COMPUTER WITH COMBINED GRAPHICS/IMAGE DISPLAY SYSTEM HAVING PIXEL MODE FRAME BUFFER INTERPRETATION

[75] Inventor: Steven M. Hancock, Boca Raton, Fla.

[73] Assignee: International Business Machines Corporation, Armonk, N.Y.

[21] Appl. No.: 176,879

[22] Filed: Jan. 3, 1994

[51] Int. Cl.[6] ..... G09G 5/04

[52] U.S. Cl. ..... 345/154; 345/153

[58] Field of Search ..... 345/154, 153, 345/155, 114, 115, 116

[56] References Cited

U.S. PATENT DOCUMENTS

| | | | |
|---|---|---|---|
| 4,789,854 | 12/1988 | Ishii | 340/703 |
| 4,808,989 | 2/1989 | Tabata | 340/750 |
| 4,866,524 | 9/1989 | Six | 358/183 |
| 4,954,970 | 9/1990 | Walker | 364/521 |
| 4,994,914 | 2/1991 | Wiseman | 358/160 |
| 5,119,074 | 6/1992 | Greaves et al. | 345/154 |
| 5,258,747 | 11/1993 | Oda et al. | 345/153 |
| 5,506,604 | 4/1996 | Nally et al. | 345/154 |

*Primary Examiner*—Kee M. Tung
*Assistant Examiner*—Matthew Luu
*Attorney, Agent, or Firm*—Douglas R. McKechnie

[57] ABSTRACT

Pixel-mode frame buffer interpretation is used to concurrently display graphical and image data in a common resolution. Pixel data in a frame buffer can be of varying types. A mask is stored in video memory and defines the "state" of each pixel. The pixel state determines how a video controller is to interpret the pixel data for that pixel and thus allows the concurrent display of graphics data and image data.

13 Claims, 5 Drawing Sheets

SYSTEM MEMORY
MAIN PROCESSOR
GRAPHICS COPROCESSOR
CONTROL CMDS
RESULTS
PIXEL MODE
WRITE MODE REG.
VIDEO MEMORY ACCESS CONTROLLER
PIXEL DATA VALUES
PIXEL STATE VALUES
VIDEO MEMORY
PIXEL DATA
PIXEL STATE MASK
ROUTER
PIXEL STATE INTERPRETER
YUV TO RGB CONVERTER
CLUT
MUX
MUX
TRANPARENCY WEIGHTER
MUX
VIDEO DISPLAY CONTROLLER
R
G
B
DAC
ANALOG RGB
DISPLAY
36A
36B
36C

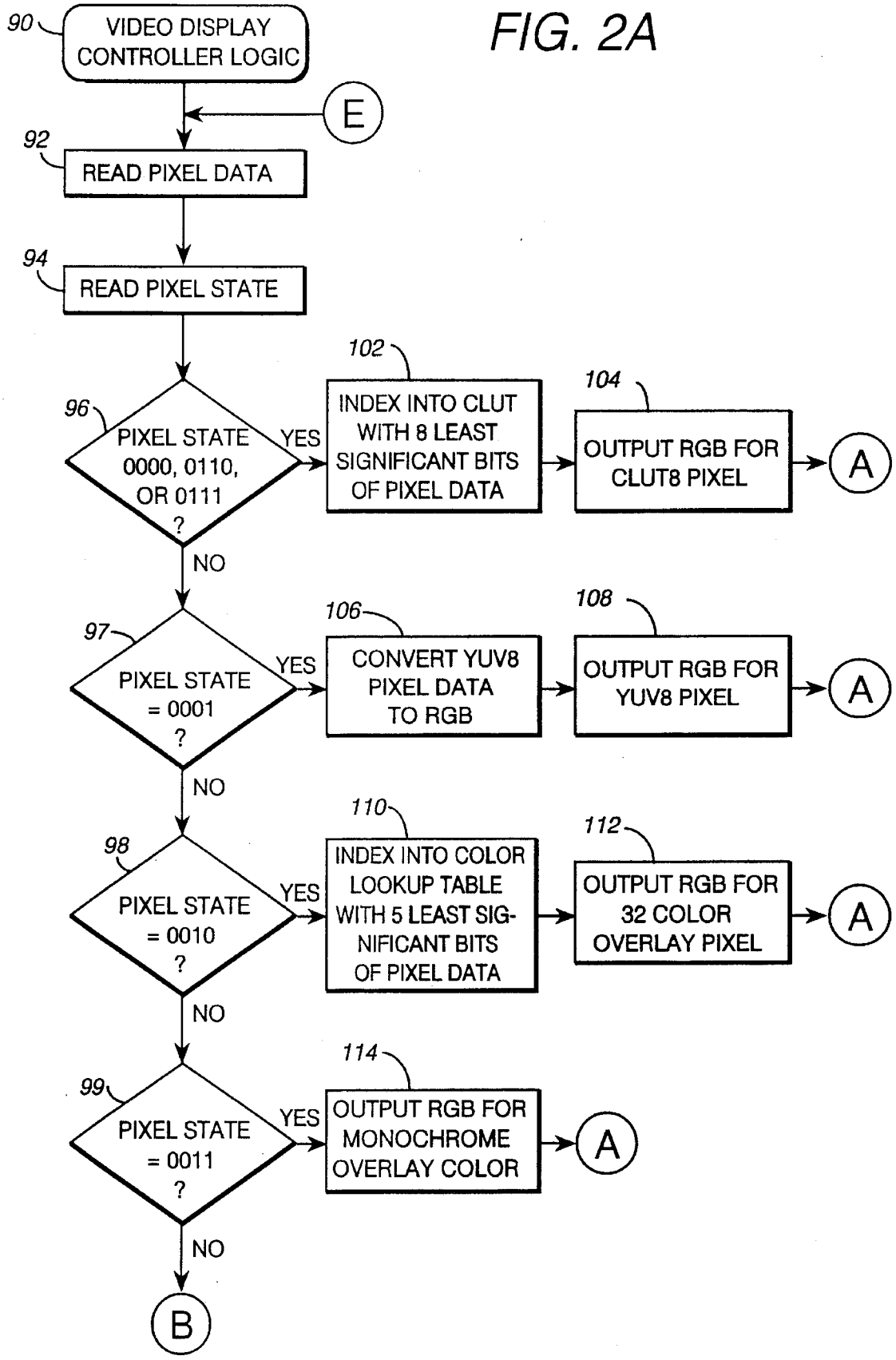
FIG. 2A
90
VIDEO DISPLAY CONTROLLER LOGIC
E
92
READ PIXEL DATA
94
READ PIXEL STATE
96
PIXEL STATE 0000, 0110, OR 0111 ?
YES
102
INDEX INTO CLUT WITH 8 LEAST SIGNIFICANT BITS OF PIXEL DATA
104
OUTPUT RGB FOR CLUT8 PIXEL
A
NO
97
PIXEL STATE = 0001 ?
YES
106
CONVERT YUV8 PIXEL DATA TO RGB
108
OUTPUT RGB FOR YUV8 PIXEL
A
NO
98
PIXEL STATE = 0010 ?
YES
110
INDEX INTO COLOR LOOKUP TABLE WITH 5 LEAST SIGNIFICANT BITS OF PIXEL DATA
112
OUTPUT RGB FOR 32 COLOR OVERLAY PIXEL
A
NO
99
PIXEL STATE = 0011 ?
YES
114
OUTPUT RGB FOR MONOCHROME OVERLAY COLOR
A
NO
B B
100
PIXEL STATE = 0100 ?
YES
116
EXTRACT R,G,B LEVELS FROM 16 BIT PIXEL DATA
118
OUTPUT RGB FOR RGB16 PIXEL
A
NO
101
PIXEL STATE = 0101 ?
YES
120
CONVERT YUV16 PIXEL DATA TO RGB
122
OUTPUT RGB FOR YUV16 PIXEL
A
NO
124
INDEX INTO COLOR LOOKUP TABLE WITH PIXEL DATA MOST SIGNIFICANT BYTE
$R_G, G_G, B_G$
126
CONVERT YUV8 PIXEL DATA FROM LEAST SIGNIFICANT BYTE TO RGB
$R_I, G_I, B_I$
128
PIXEL STATE = 1000 ?
YES
136
GRAPHICS COEFF = .11
IMAGE COEFF. = .89
D
NO
C C
129
PIXEL STATE = 1001 ?
YES
137
GRAPHICS COEFF = .22
IMAGE COEFF. = .78
D
NO
130
PIXEL STATE = 1010 ?
YES
138
GRAPHICS COEFF = .33
IMAGE COEFF. = .67
D
NO
131
PIXEL STATE = 1011 ?
YES
139
GRAPHICS COEFF = .44
IMAGE COEFF. = .56
D
NO
132
PIXEL STATE = 1100 ?
YES
140
GRAPHICS COEFF = .55
IMAGE COEFF. = .45
D
NO
133
PIXEL STATE = 1101 ?
YES
141
GRAPHICS COEFF = .66
IMAGE COEFF. = .34
D
NO
134
PIXEL STATE = 1110 ?
YES
142
GRAPHICS COEFF = .77
IMAGE COEFF. = .23
D
NO
143
GRAPHICS COEFF = .88
IMAGE COEFF. = .12
D FIG. 2D
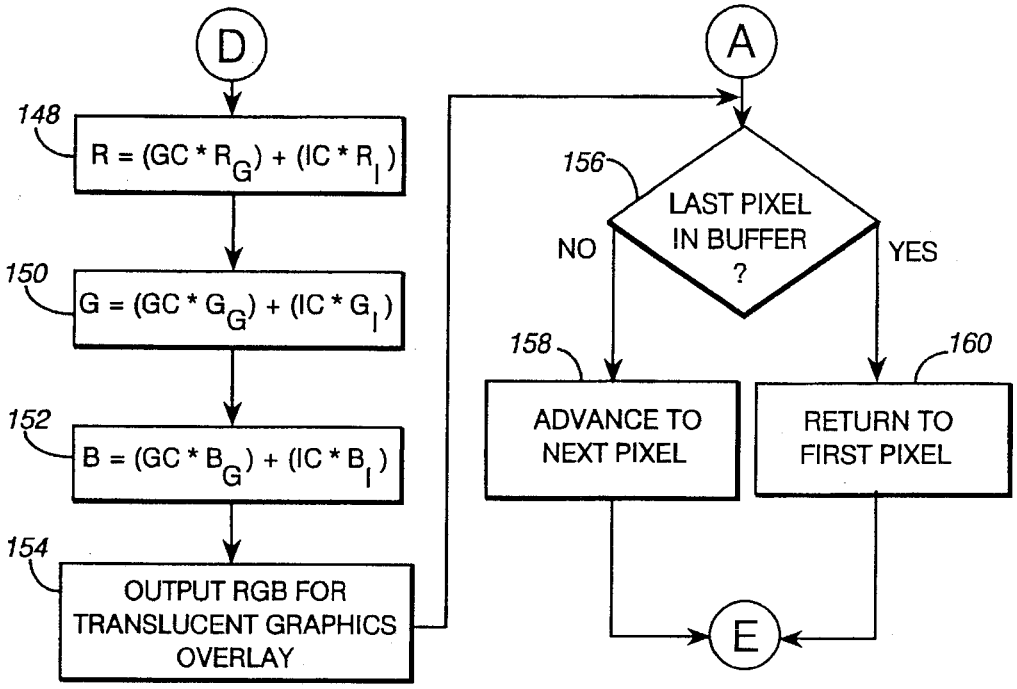
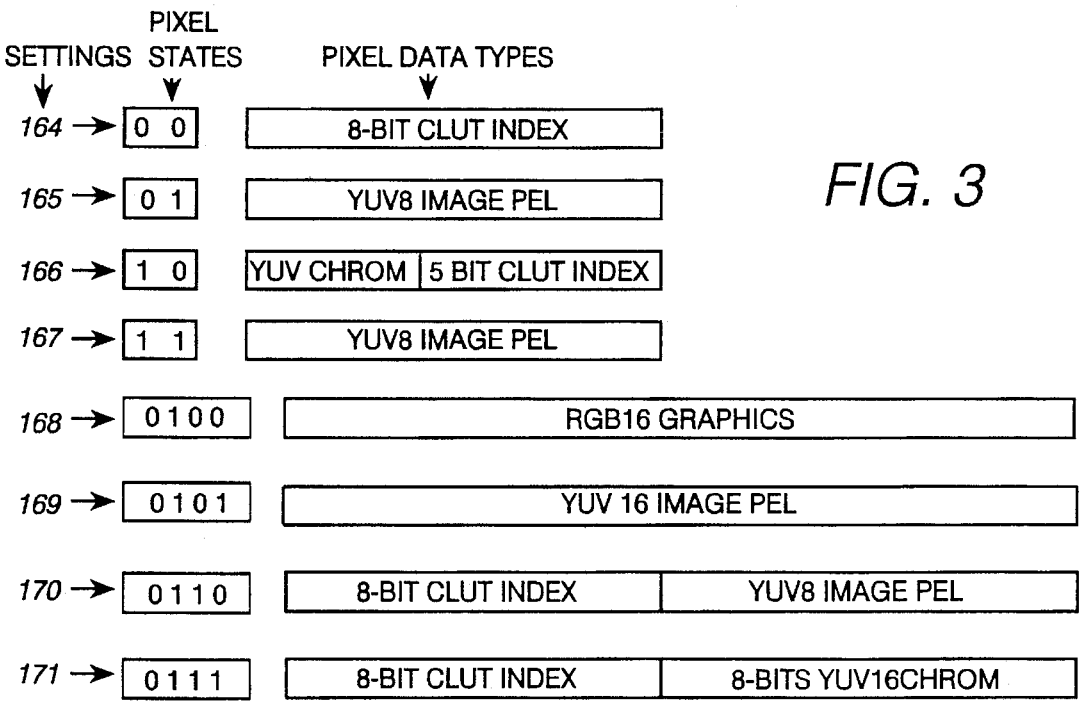
FIG. 3

PERSONAL COMPUTER WITH COMBINED GRAPHICS/IMAGE DISPLAY SYSTEM HAVING PIXEL MODE FRAME BUFFER INTERPRETATION

BACKGROUND OF THE INVENTION

1. Field of the Invention

This invention relates to the field of data processing, and, more particularly, to an improved video subsystem for concurrently displaying graphic and image data on a screen using pixel-mode interpretation.

2. Description of Related Art

Display architectures have historically provided "modes" that select a trade-off between resolution and color space. Dual plane multimedia display systems are faced with further trade-offs in allocation of video memory and bandwidth between the image and graphics layers. Addressing the diverse requirements of various applications sharing a screen in a graphical user interface cannot be accomplished efficiently with modes that apply to the entire screen.

Previous implementations of multimedia video hardware systems have taken two basic approaches for display of natural images. One approach is a single plane color lookup table (CLUT) or direct RGB (red-green-blue) graphics, and the other is a dual layer system with in-buffer image compression. RGB direct color systems require a minimum of 16-bits per pixel to achieve acceptable rendering of images. Color lookup table (palette) systems require a minimum of 8-bits per pixel to index into the color palette, and the palette must be calculated for each image to get the best results. Palette systems are limited when images using different palette selections are displayed concurrently, or when the range of colors present in an image is so varied that the limitation of 256-colors becomes noticeable.

One drawback of the single layer RGB design is that it does not take advantage of in-buffer compression methods that enable display of image with less video memory than that required by direct RGB color. RGB image display is therefor more costly in that the additional video memory required for image display goes largely unused in the display of traditional graphics and typographic font output of applications. Another disadvantage is that graphics overlays of image are always destructive, i.e., the image must be restored when the overlay is moved or removed. This is particularly significant when the image is being updated from a live input which is frozen; the data will not be present when the overlay is removed. A final limitation is that since RGB direct color does not use a palette or color table lookup, palette animation techniques are precluded.

On the other hand, dual layer systems with in-buffer image compression enable display of a natural image with fewer bits per pixel by storing the image in a compressed format in video buffer separate from the graphics video buffer, which is considered a second "layer", and multiplexing the outputs of the graphics video buffer and the image video buffer. This is usually one of several various subsampled luminance/chrominance formats commonly referred to as "YUV" formats that take advantage of the characteristics of the human visual system in which chrominance or color is not as perceptible as luminance or brightness. Since image and graphics data are stored separately, dual layer systems require video memory for both the graphics and image layers. This generally is a minimum of 16-bits per pixel; 8-bits per pixel for graphics, and 8-bits per pixel for a YUV8 image.

Dual layer systems have two advantages over single layer systems. First, the second layer permits independent manipulation of graphics overlay in a nondestructive fashion, i.e., graphics does not modify the underlying image so it can be removed or repositioned without having to "heal" the image. Second, the image data stored in the second layer can be stored in a compressed image format thus conserving video memory space and bandwidth.

Dual layer systems also have drawbacks. With two layers, at any given time any pixel on the screen is represented by information from only one of the layers because the user sees only one layer at a time. The information in one of the buffers for each pixel is unused so in a sense the dual layer display wastes some of the information in the buffer because it is storing information the user cannot see. At lower resolutions this is not a major consideration, but at higher resolutions, such as 1024×768, the additional memory usage represents a significant increase in cost. Depending on the memory increment of the hardware technology employed, providing CLUT8 graphics and YUV8 buffers in a dual layer system (16-bits per pixel total) requires 1.5 to 2 megabytes (MB) of video memory. Assuming 1.0 MB as a reasonable cost point, 1024×768 resolution imposes a limit of 10-bits per pixel.

SUMMARY OF THE INVENTION

One of the objects of the invention is to provide an improved video subsystem for concurrently displaying graphics and image data.

Another object of the invention is to concurrently display graphics and image data while using less memory space than would be required by a dual-layer display.

A further object of the invention is to concurrently display graphics and image data using less video memory than would otherwise be required for particular image quality level.

Still another object of the invention is to display image data that is overlaid with graphics data while using less memory space than would be required by a dual-layer display.

A further object of the invention is to provide translucent graphics overlays of images combining different degrees of mix between different types of pixel data.

Briefly, in accordance with the invention, pixel-mode frame buffer interpretation is used to concurrently display graphical and image data in a common resolution. Pixel data in a frame buffer can be of varying types. A mask is stored in video memory and defines the "state" of each pixel. The pixel state determines how the video controller is to interpret the pixel data for that pixel and thus allows the concurrent display of graphics data and image data.

BRIEF DESCRIPTION OF THE DRAWINGS

Other objects and advantages of the invention will be apparent from the following description taken in connection with the accompanying drawings wherein:

FIGS. 2A–D form a flow chart of the logic of the video display controller shown in FIG. 1; and FIG. 3 is a diagram showing relationship between certain values of a pixel state mask and the states of the pixels represented thereby.

DESCRIPTION OF ILLUSTRATIVE EMBODIMENT

Figure 1:
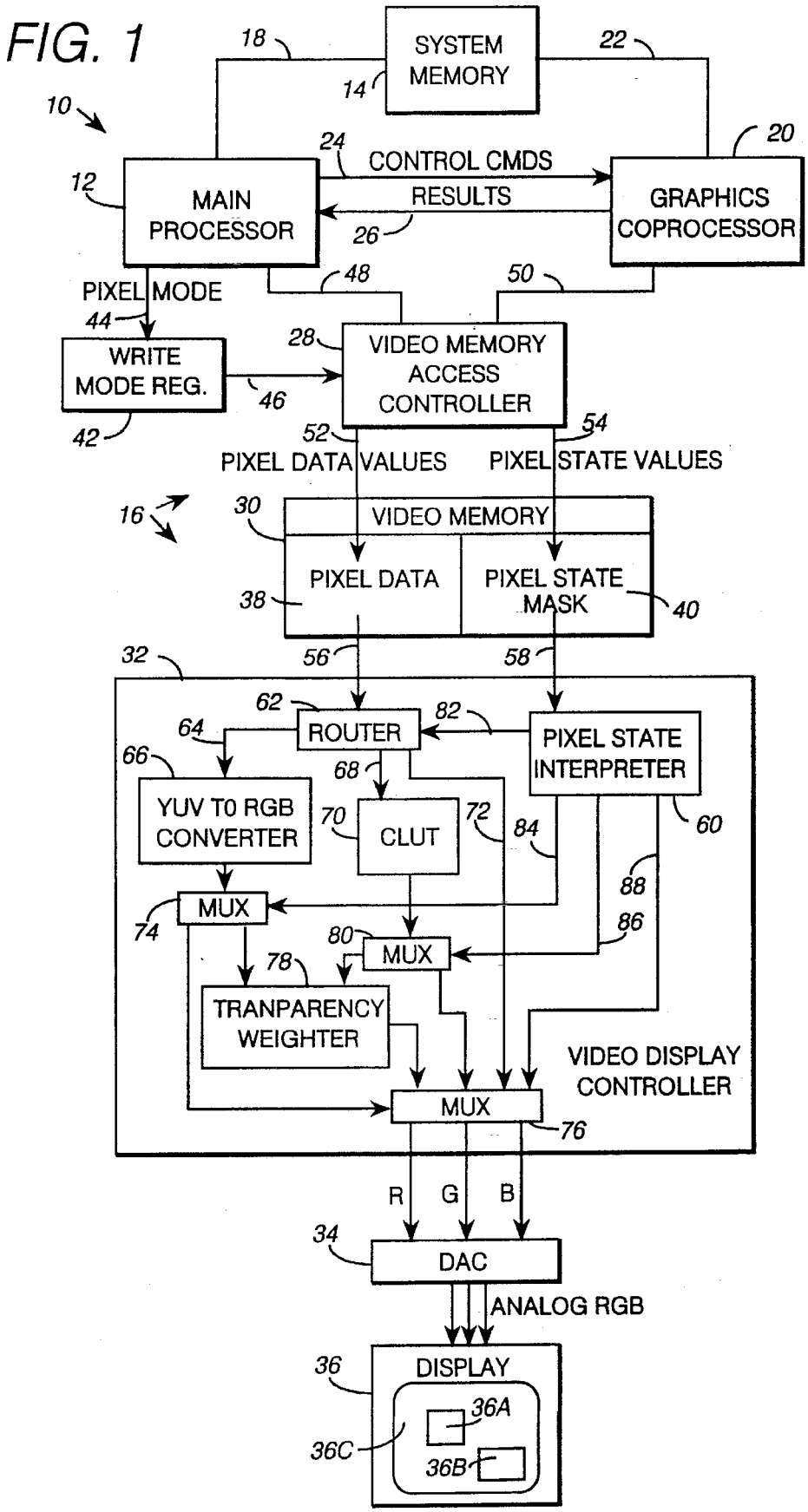
FIG. 1 is a block diagram of a data processing system embodying the invention.

Referring now to the drawings, FIG. 1, shows the major elements of a data processing system (DPS) 10 that embodies the invention. DPS 10 comprises a main processor 12, a system memory 14, and a video subsystem 16. DPS 10 may be an IBM PS/2 model 57 multimedia personal computer in which the video subsystem is an extended graphics array (XGA) modified to incorporate the invention, in the manner described below. It is to be appreciated that personal computers have many different components of which only those necessary for an understanding of the invention, are shown. Thus, the drawings are oriented to the display aspects of DPS 10. Processor 12 accesses memory 14 by a bus 18. Video subsystem 16 includes a graphics coprocessor 20 that similarly accesses memory 14 by a bus 22. Coprocessor 20 operates asynchronously relative to processor 12 but under the direction of the main processor. Processor 12 sends "control commands" to coprocessor 20 over a bus 24 and receives the "results" by bus 26. The control commands cause the coprocessor to perform functions such as transferring a block of pixel data between the system memory and the video memory. The "results" may signify successful completion of a function or that an error occurred.

Video subsystem 16 further comprises a video memory access controller 28, a video memory 30, a video display controller 32, a digital-to-analog converter (DAC) 34, and a color display or monitor 36. Such components operate in the following general manner. Processor 12, under application program control, writes pixel data into video memory 30 asynchronously relative to the operation of display controller 32. The pixel data written by processor 12 defines the appearance of what is presented on display 36. Controller 32 continuously accesses the pixel data in memory 30 one pixel at a time and decides what color to make a pixel. The controller produces an output for each pixel which comprises three digital signals R, G, B which respectively define the intensities of red, green and blue color values of the pixel. These output signals are transmitted to DAC 34 that converts the digital signals into analog RGB signals for illuminating or driving each pixel of display 36 to emit the color defined by the pixel data. This general operation is in accordance with the prior art. Details of the operation are modified in accordance with the invention, as described below.

Before proceeding with further description of FIG. 1, a discussion of different types of pixel data might facilitate a better understanding of the invention. As indicated in the above summary, the invention is concerned with the simultaneous, concurrent display of both graphics and image data. For both types of data, there are different known formats in which the number of bits used for each pixel differs dependent upon the size or capacity of the video memory. Two common formats for color data are a RGB16 format and a YUV16 format. The RGB16 format uses 16-bits where five bits are for red significance, six bits are for green significance, and five bits are for blue significance. This format can be expressed as R5:G6:B5 and stored as one 16-bit (two byte) word. The YUV16 format is used to represent pairs of adjacent pixels in a scan line where the format includes an 8-bit intensity value unique to a pixel and an 8-bit chrominance value shared with the paired pixel. In each pair, the first pixel data has an 8-bit Y value and an 8-bit Cr value, and the second pixel has an 8-bit Y value and an 8-bit Cb value, where Y is the luminance value unique to each pixel, and Cr and Cb are chrominance values shared by the two pixels.

The sharing of chrominance data thereby reduces the average number of bits per pixel. "Graphics" data, such as text, numerics, etc., are best represented by RGB formats, while "natural image" data, such as motion video and photographic still images, are commonly represented by YUV formats.

Referring again to FIG. 1, in accordance with the invention, video memory 30 comprises a pixel data region 38 and a pixel state mask 40. Pixel data region 38 has a plurality of memory locations corresponding to the pixels in display 36 where each location stores the pixel data that determines what color is displayed by the corresponding pixel. Pixel state mask 40 has a plurality of locations corresponding one-for-one with the pixel data locations in region 38. By providing the state information on a per pixel basis, applications can select the representation best suited for their output, and applications displaying pixels represented by various data types can be shown on the screen concurrently from a single video frame buffer. By way of example, display 36 could present a screen having a graphics window 36A, an image window 36B, and a background 36C of graphics overlaying image.

The size of video memory 30 obviously depends upon the number of pixels in the display and how many bits are used to represent each pixel data and each pixel state mask. Two exemplary implementations are described. One implementation is a 20-bit system in which two bytes (16-bits) represent pixel data and 4-bits represent the corresponding pixel state mask. In a 10-bit implementation, one byte (8-bits) represent pixel data and 2-bits represent the corresponding pixel state mask. The implementation having the larger number of bits allows a greater number of different pixel data types to be displayed, while the 10-bit implementation is well suited to low cost multimedia systems for the consumer market.

A write mode register 42 is connected by bus 44 to receive PIXEL MODE signals from the processor. These signals are stored in register 42 until being overwritten and they control the writing or setting of the pixel state mask 40 as pixel data is written into the video memory. Register 42 is 4-bits wide for the 20-bit implementation and 2-bits wide for the 10-bit implementation. Controller 28 is connected by control lines 46 to register 42 and automatically sets corresponding locations of pixel state mask 40, as pixel data is written into region 38, in accordance with the setting of the register 42. Main processor 12 and coprocessor 20 are connected by busses 48 and 50 to controller 28. While either 12 or 20 can write the pixel data, only processor 12 is able to set register 42 and control the setting of the pixel state mask.

Controller 32 comprises a pixel state interpreter 60 and a router 62 respectively connected by busses 58 and 56 to receive pixel state values from mask 40 and pixel data values from region 38. Controller also includes a converter 66 for converting YUV pixel data to RGB pixel data, a color lookup table (CLUT) 70, and a transparency weighter 78, for processing pixel data in the manner described below. Interpreter 60 controls the routing or flow of data through controller 32 by selectively sending control signals to router 62, and multiplexors (MUXes) 74, 76, and 80 over control lines 82, 84, 88 and 86 respectively, in accordance with the pixel state value set in interpreter 60.

Figure 2B:
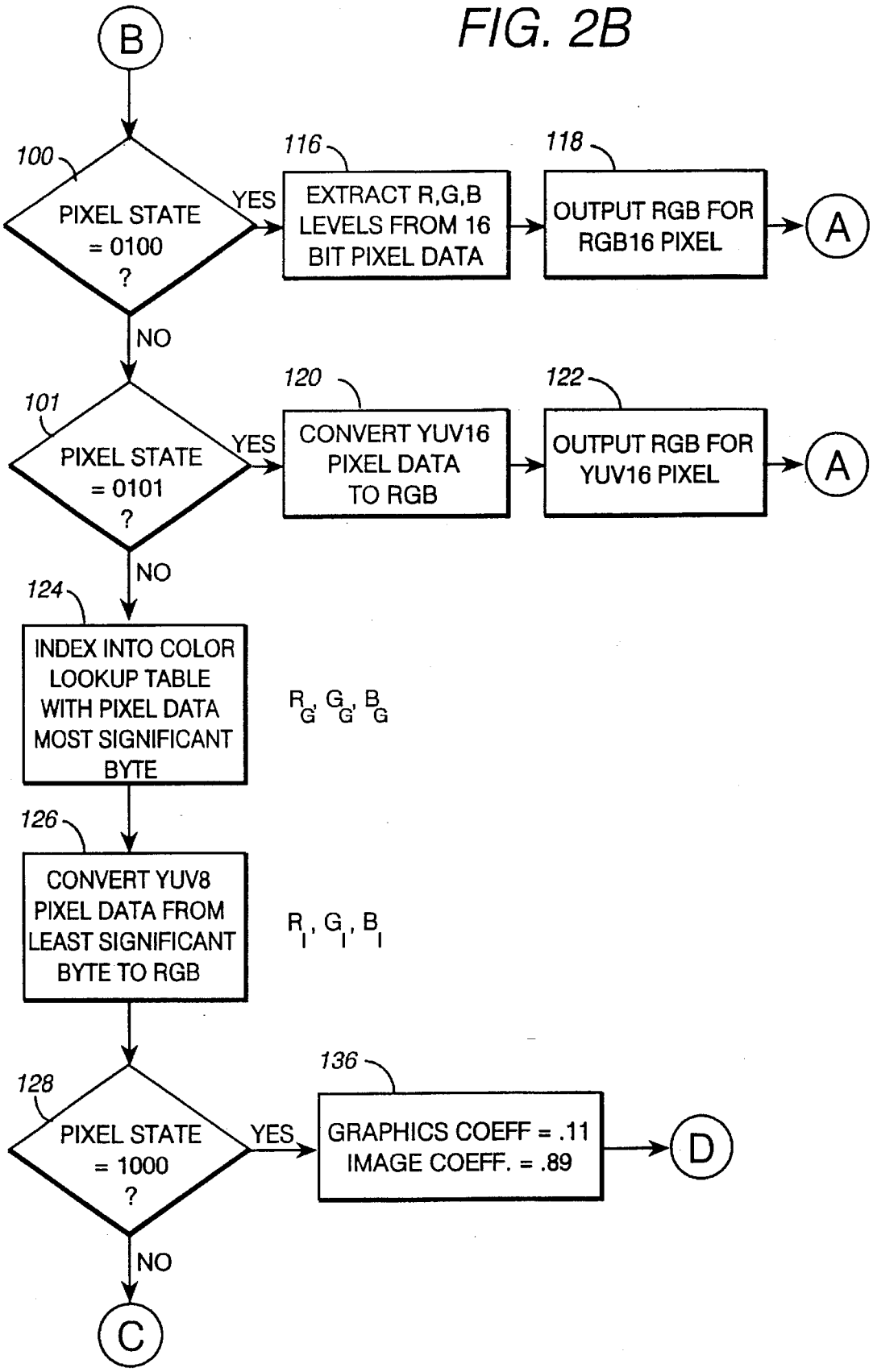

Referring to the flow chart, and first to FIG. 2A, the video display logic 90 operates controller 32 in the following manner. Pixel data is read in step 92 one pixel at a time. Step 94 then reads the corresponding pixel state mask into interpreter 60. Then, one or more successive decisions 96–101 are made to detect or interpret the pixel state value and perform different functions dependent on the particular pixel state value. If the results from each of decisions 96–101 is negative, the pixel data is interpreted as being for mixing operations that begin with step 124.

Figure 2C:
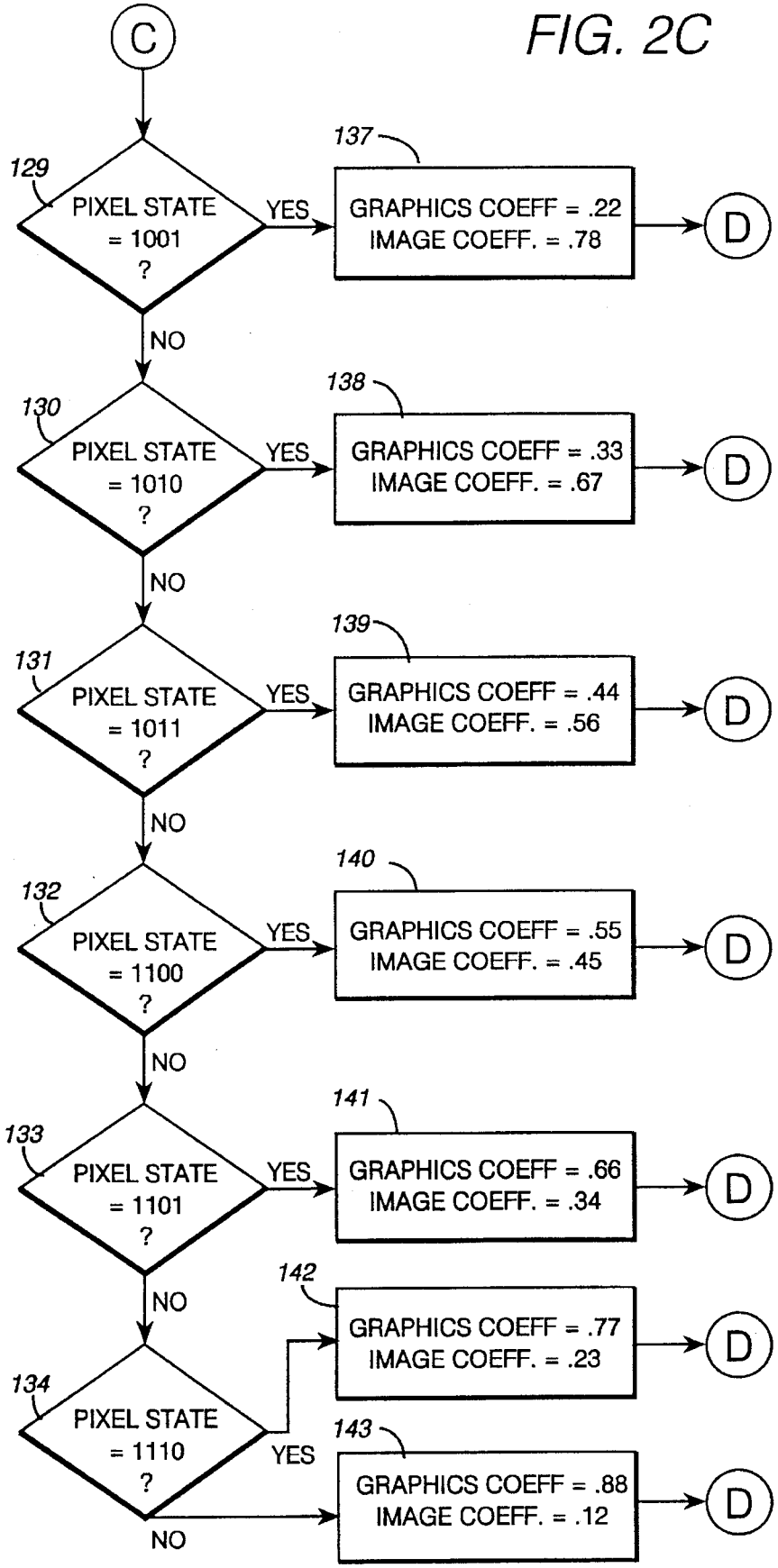

The description hereinafter references both FIGS. 2 and 3, so at this point a brief description is given of the diagram in FIG. 3. A series of settings 164–171 are shown for different pixel states and corresponding types of pixel data defined by the states. Settings 164–167 are common to both implementations whereas the others are used in only the 20-bit implementation. Settings 164–167 are respectively used for CLUT8 graphics, YUV8 images, 32-color graphics overlays, and non-destructive monochrome overlays. Settings 168–171 are respectively used for RGB16 graphics, YUV16 images, CLUT8 graphics overlays of YUV8 images, and CLUT8 graphics overlays of YUV16 images.

Referring back to FIG. 2A, decision 96 detects binary values of 0000, 0110, and 0111 and branches to step 102 which, in turn, indexes CLUT 70 using the eight least significant bits of pixel data as an 8-bit index into CLUT 70. As a result of the index and lookup caused thereby, CLUT 70 outputs an RGB16 value that is processed by step 104 in a manner dependent upon the particular pixel state. Upon completion of step 104, control then passes through connector A (indicated by a circle enclosing the A) to step 156 (FIG. 2D) for processing another pixel.

When the pixel state is 0000 (setting 164—FIG. 3), the RGB output from CLUT 70 is sent to DAC 34 to produce a CLUT8 graphics pixel. When the pixel state is 0110 (setting 170—FIG. 3), the CLUT 70 output is sent to DAC 34 to overlay the YUV8 image. This mode is non-destructive, i.e., graphics data and image data may be manipulated independently. The graphics data and the image data for the pixel may be manipulated independently. Hence, when a graphics overlay is moved or removed the underlying image does not have to be restored. When the pixel state is 0111 (setting 171—FIG. 3), the luminance information in the YUV16 image data is overwritten with the CLUT 70 output. As such, the mode is destructive and image data must be restored when a graphics overlay is moved or removed.

Step 97 detects setting 165 (FIG. 3) in which the pixel data has a YUV8 format comprising a 5-bit Y value to represent luminance unique to a pixel and a 3-bit Cr or Cb value used to represent chrominance shared by each set of four pixels in a scan line. In step 106, converter 66 converts the YUV8 signals into an RGB signal, and step 108 then outputs the RGB signal to the DAC to produce a YUV8 image pixel or pel. The conversion may be done in accordance with the following formulas:

$$R=Y+1.403(Cr-16)$$

$$G=2Y-1.43(Cr-16)-0.688(Cb-16)$$

$$B=Y+1.773(Cb-16)$$

the values being rounded to nearest integers in the ranges where R is from 0 to 31, G is from 0 to 63, and B is from 0 to 31.

Steps 98 and 99 (settings 166 and 167—FIG. 3) are used to detect color and monochrome overlay data. For color overlays, i.e., using different colors in the overlay as opposed to only a single monochrome color, step 98 passes to step 110 which uses the five least significant bits as an index into the first 32-RGB values in CLUT 70. Step 112 then outputs the RGB value to DAC 34 to produce a pixel in which graphics data overwrite 5-bits of luminance information in the YUV8 image data. In this mode, overlays are limited to 32 colors in order to preserve the 3-bits of chrominance information necessary to display adjacent YUV image pels.

When step 99 detects a pixel state of 0011, step 114 then outputs an RGB value for a monochrome overlay. This mode is useful for manipulating visual objects such as a "rubber band box" that must move quickly under user control. The mode is nondestructive in that it preserves the image data and avoids the need to restore the image data as the overlay is moved or removed, but it is limited to a single color. The color can be selected from a hardware register (which would apply to the entire screen) or the color could be generated on the fly for each pixel such that the overlay contrasts with the image pixel data.

Steps 100 and 101 (settings 168 and 169—FIG. 3) are used for producing RGB16 and YUV16 pixel colors. From step 100, step 116 extracts the RGB levels and step 118 outputs the signals. The YUV data is sent to converter 66 for conversion to RGB in step 120, and this is outputted in step 122.

As indicated above, if the results from all of steps 96–101 are negative, step 126 is then performed to begin transparency operations. In such operations, the pixel data value is two bytes where the most significant byte is an index into CLUT 70 and the least significant byte is in YUV8 format. Step 124 uses the index to look-up the corresponding $RGB_G$ value and step 126 converts the YUV byte into an $RGB_I$ value. These respective values are then inputted into transparency weighter 78 which first determines a graphic coefficient GC and an image coefficient IC in accordance with the pixel state value in steps 128–143, and then calculates an RGB value according to the formulas in steps 148–152. By way of example, if the pixel state is "1100", tests 128–131 then produce negative results, and step 132 detects such value and branches to step 140 which sets the graphics coefficient GC to a value of "0.55" and the image coefficient IC to a value of "0.45".

After the RGB value has been so calculated, step 154 then outputs the resultant RGB value to the DAC, to produce a translucent graphics overlay on the display. After step 154, step 156 determines if the pixel data was for the last pixel in the video buffer. If not, step 158 advances to the address of the next pixel and then returns to step 92 to repeat the process. If the pixel data is for the last pixel in the buffer, step 160 then addresses the first pixel in the buffer, and branches also to step 92 to repeat the process.

The above described flow chart is for the 20-bit wide video memory implementation. For a 10-bit wide video memory, steps 96–98 are modified to respectively detect 2-bit pixel states of "00", "01", and "10" and then branch to steps 102, 106, and 110. Step 99 is unnecessary and step 114 would be performed in response to a "no" decision from step 98. Since such implementation is limited to four different pixel states, the remaining detection and processing steps up to step 156, are eliminated.

The overlay pixel modes are the primary functional difference between the pixel mode, frame buffer interpretation of the invention and dual layer multimedia hardware of the prior art. Graphics overlay can be performed destructively or non-destructively. Destructive overlay requires the image be restored when the graphic overlay is moved or removed, whereas nondestructive overlay allows independent manipulation of graphics and image data. While dual layer displays provide independent buffers for graphics and image data, the requirement for restoring image data is not eliminated, as windowing operations in a graphical user interface may require "healing" of images in either layer.

It should be apparent to those skilled in the art that many changes can be made in the details and arrangements of steps and parts without departing from the scope of the invention as defined in the appended claims.

What is claimed is:

1. Data processing apparatus comprising:

a color display having a plurality of pixels;

a video memory having a plurality of first locations for storing different types of pixel data and a plurality of second locations for storing pixel states, each of said first locations corresponding to a different one of said pixels, each of said second locations corresponding to a different one of said first locations, said pixel data defining the colors produced by said pixels, said pixel states defining what type of pixel data is stored at the corresponding first location, said different types of pixel data including graphics pixel data and image pixel data;

first means connected to said video memory for writing pixel data into said first locations;

second means connected to said video memory for writing pixel states into said second locations; and third means including a video display controller connected to said display and to said video memory for reading said pixel data and said pixel states from said video memory and operating said display in accordance therewith to concurrently display graphics data and image data, said video display controller comprising fourth means operative to interpret pixel data for each pixel in accordance with the pixel state for such pixel data and produce controller output signals for operating said display.

2. Apparatus in accordance with claim 1 comprising:

a pixel mode register selectively settable to a plurality of settings corresponding to the number of types of pixel data;

processing means for first setting said register and then writing pixel data into said video memory; and said second means comprises a video memory access controller connected to said register for setting said pixel states in said video memory in accordance with the setting of said pixel mode register to define the type of pixel data written into said video memory.

3. Apparatus in accordance with claim 2 wherein:

said display is an analog display;

said controller output signals are digital RGB signals for controlling red, green and blue color intensities of said pixels; and said apparatus further comprises a digital-to-analog converter (DAC) connected to said video display controller and said display for converting said digital RGB signals from said video display controller into analog RGB signals that drive said display.

4. Apparatus in accordance with claim 3 wherein:

said fourth means comprises a color look-up table (CLUT) storing a plurality of different RGB signals;

said graphics pixel data is an index into said CLUT; and said fourth means is operative produce an output signal for a pixel by using said index to look-up an RGB signal in said CLUT.

5. Apparatus in accordance with claim 4 wherein:

said image pixel data has a YUV format including luminance values and chrominance values; and said fourth means comprises a converter for converting signals in said YUV format into said RGB controller output signals.

6. Apparatus in accordance with claim 5 wherein said image pixel data for a pixel includes a luminance value unique to such pixel and a chrominance value shared by at least one adjacent pixel.

7. Apparatus in accordance with claim 6 wherein said processing means writes graphics data into one area of said video memory and image data into another area of said video memory to produce separate graphics and image areas on said display.

8. Apparatus in accordance with claim 6 wherein said processing means writes image data into one area of said video memory and graphics data into at least portions of said one area to produce a graphics overlay of image data on said display.

9. Apparatus in accordance with claim 8 wherein said graphics data is of two different types including a monochrome type for producing a monochrome overlay, and a multicolor type for producing a multicolor overlay.

10. Apparatus in accordance with claim 8 comprising a transparency weighter for producing said graphics overlay, said pixel data comprising an index into said CLUT for looking up a first RGB value, and a YUV format; said weighter comprising means for mixing said first RGB value and such YUV format in a proportion determined by one of said pixel states to create an RGB value that is transmitted to said DAC.

11. Apparatus in accordance with claim 8 wherein:

each pixel is represented in said video memory by 10-bits including 2-bits for pixel state and 8-bits for pixel data; and each pixel state defining four types of pixel data including an index into said CLUT table, a YUV format, and two graphic overlay types.

12. Apparatus in accordance with claim 8 wherein:

each pixel is represented in said video memory by 20-bits including 4-bits for pixel state and 16-bits for pixel data; and each pixel state defining sixteen types of pixel data including an index into said CLUT table, a YUV format having 8-bits, a YUV format having 16-bits, an RGB format having 16-bits, and twelve graphic overlay types.

13. Data processing apparatus comprising:

an analog color display having a plurality of pixels;

a video memory having a plurality of locations for storing video information to be displayed, said video information including different types of pixel data and pixel states defining the type of pixel data corresponding to each pixel, said different types of pixel data including graphics pixel data and image pixel data, said image pixel data having a YUV format including a luminance value unique to the corresponding pixel and a chrominance value shared by at least one pixel adjacent pixel to said corresponding pixel, said graphics data including a table look-up index;

first means connected to said video memory for writing said video information into said video memory, said first means comprising a pixel mode register selectively settable to a plurality of settings corresponding to the types of pixel data, and a video memory access controller connected to said register and said video memory for setting said pixel states in said video memory in accordance with the setting of said pixel mode register to define the type of pixel data written into said video memory;

second means connected to said video memory and to said display for reading video information from said video memory and operating said display to concurrently display graphics data and image data, said second means comprising a video display controller having an input for receiving video information from said video memory and an output for transmitting digital RGB controller output signals that control red, green and blue color intensities of said pixels, and a digital-to-analog converter (DAC) connected to said display for converting said digital RGB controller output signals into analog RGB signals that drive said display;

said video display controller comprising a color look-up table (CLUT) storing a plurality of different RGB signals and outputting one such RGB signal in response to receiving an index type of pixel data, a converter for converting signals in said YUV format into RGB output signals, and third means including a interpreter for receiving said pixel states and selectively routing said pixel data to said CLUT and said converter dependent upon the type of pixel data, and for routing outputs from said CLUT and said converter to said output of said controller.

* * * * *